US005620837A

United States Patent [19]

Kim et al.

[11] Patent Number: 5,620,837

[45] Date of Patent: Apr. 15, 1997

[54] COLOR PHOTOGRAPHIC ELEMENT CONTAINING BENZAZOLIUM COMPOUNDS

[75] Inventors: Sang H. Kim, Pittsford; Arlyce T. Bowne, Rochester; Thomas J. Dannhauser, Pittsford, all of N.Y.

[73] Assignee: Eastman Kodak Company, Rochester, N.Y.

[21] Appl. No.: 579,984

[22] Filed: Dec. 28, 1995

[51] Int. Cl.[6] ..... G03C 1/46

[52] U.S. Cl. ..... 430/506; 430/509; 430/600; 430/603; 430/607; 430/611; 430/613; 430/614; 430/615; 430/379; 430/407; 430/510; 430/517

[58] Field of Search ..... 430/506, 509, 430/502, 503, 600, 603, 607, 611, 613, 614, 615, 379, 407, 507, 510, 517, 551

[56] References Cited

U.S. PATENT DOCUMENTS

| | | | |
|---|---|---|---|
| 2,131,038 | 9/1938 | Brooker et al. | 95/7 |
| 3,326,681 | 6/1967 | Walworth | 96/3 |
| 3,954,478 | 5/1976 | Arai et al. | 96/100 |
| 4,237,214 | 12/1980 | Mifune et al. | 430/441 |
| 4,374,196 | 2/1983 | Herz | 430/505 |
| 4,423,140 | 12/1983 | Herz | 430/445 |
| 4,578,348 | 3/1986 | Freeman et al. | 430/607 |
| 4,596,767 | 6/1986 | Mihara et al. | 430/576 |
| 4,780,400 | 10/1988 | Beltramini et al. | 430/505 |
| 4,948,721 | 8/1990 | Lok et al. | 430/614 |
| 5,149,619 | 9/1992 | Mihara et al. | 430/572 |
| 5,250,403 | 10/1993 | Antoniades et al. | 430/505 |
| 5,298,369 | 3/1994 | Munshi et al. | 430/379 |
| 5,320,938 | 6/1994 | House et al. | 430/567 |
| 5,354,650 | 10/1994 | Southby et al. | 430/222 |
| 5,411,854 | 5/1995 | Brust et al. | 430/614 |
| 5,437,968 | 8/1995 | Nagaoka | 430/506 |
| 5,460,932 | 10/1995 | Chen et al. | 430/544 |

FOREIGN PATENT DOCUMENTS

| | | |
|---|---|---|
| 0250740B1 | 4/1987 | European Pat. Off. . |
| 0250740A3 | 4/1989 | European Pat. Off. . |
| 0250740A2 | 4/1989 | European Pat. Off. . |
| 0377889 | 12/1989 | European Pat. Off. . |

OTHER PUBLICATIONS

JP 04027947, abstract.

*Primary Examiner*—Geraldine Letscher
*Attorney, Agent, or Firm*—Sarah Meeks Roberts

[57] ABSTRACT

This invention provides a color silver halide photographic element comprising a support having situated thereon a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; wherein at least one of the dye-forming units comprises two or more emulsion layers spectrally sensitized to the same region of the visible spectrum, but exhibiting different photographic sensitivities, each such emulsion layer containing an image dye-forming coupler wherein at least one, but not all, of the emulsion layers of the dye-forming unit contains the hydrolyzed or unhydrolyzed form of a benzazolium compound represented by formula (I):

(I)

25 Claims, No Drawings

COLOR PHOTOGRAPHIC ELEMENT CONTAINING BENZAZOLIUM COMPOUNDS

FIELD OF THE INVENTION

This invention relates to a color silver halide photographic element having at least one emulsion layer containing certain benzazolium compounds in a multilayer format which makes it suitable for what is known in the art as "push processing". This invention more specificially relates to color silver halide reversal photographic elements.

BACKGROUND OF THE INVENTION

Push processing is a technique that is used often in the photographic industry to correct for intentional or unintentional underexposures. In essence, photographers who have underexposed a photographic element—for instance, photographers who exposed a slow film at a faster than appropriate speed at an athletic event in order to photograph a participant or object in rapid motion—can compensate for the relatively small amount of silver that was formed in the underexposure, thus recapturing lost speed, by prolonging the development of the film in the black and white first developer.

Often, however, push processing results in a degradation of color balance as the increase in speed of one color record does not match that of the other color records in the element. It is desirable to provide methods which correct color imbalance independently and selectively (of specific color record and of specific density) during push processing. These methods comprise mechanisms for development inhibition and acceleration during extended first development times. U.S. Pat. No. 5,460,932 describes photographic elements containing development accelerators and compounds that release development inhibitors.

U.S. Pat. No. 5,354,650 describes photographic elements containing compounds that release development inhibitors after extended development times. Consequently these inhibitors impact the characteristics of the photographic element primarily after the initial development phase in the region of the element in which they are located. This allows one to affect color balance by slowing the development of one silver halide emulsion layer during the push phase while simultaneously allowing the other silver halide emulsion layers to continue developing without restraint.

Development accelerators are described in U.S. Pat. Nos. 3,535,487; 5,041,367; 5,460,932; and *Research Disclosure* December 1989, Item 08119, Sections XXI B-D. Development accelerators can also include such things as competitors for oxidized developer as described in U.S. Pat. No. 4,923,787; fine grain silver halide crystal (e.g. Lippmann) or fine grain silver (e.g. Carey Lea Silver), or surface or internally fogged silver halide grains as exemplified in U.S. Pat. Nos. 4,656,122; 4,082,553; 2,996,382; 3,178,282; 3,397,987; and 4,626,498. These development accelerators when incorporated in silver halide emulsion layers act to shift the emulsion characteristic curve towards lower exposure (faster speed) for each density level, often with greater effect in the lower scale than in the upper scale of the final sensitometric curve. Typically, the development accelerators achieve their effects by affecting silver development or dye formation. Also, typical development accelerators increase fog in the first developer, resulting in a loss of Dmax in the final sensitometric curve for reversal systems upon push processing and, in some cases, even with normal processing times.

The present invention provides push acceleration of the specific emulsion layer (exposure/density region) without degradation of Dmax (by increased first development fog) under both normal and push processing conditions. The present inventors have discovered that adding certain benzazolium compounds to specific layers of a multilayer film element, particularly a reversal film element, can increase the speed of a specific portion of a color record upon push processing when such an increase is desired.

Benzazolium salts have been utilized for various purposes in photographic elements. U.S. Pat. No. 3,326,681 describes the use of benzothiazolium salts containing carboxyalkyl or sulfoalkyl substituents as being useful in a diffusion transfer system as antifoggants. U.S. Pat. No. 4,578,348 describes the speed/fog relationships of certain benzothiazolium salts. U.S. Pat. No. 5,149,619 describes the use of methoxy benzothiazolium salts in silver chlorobromide infrared sensitive emulsions to increase speed. U.S. Pat. No. 5,320,938 describes the use of benzothiazolium salts as incubation stabilizing agents when added after sensitization of high chloride tabular grain emulsions. However, none of these references describes or suggests the use of a certain class of benzazolium salts to improve color balance in reversal elements when "push processing" is utilized.

SUMMARY OF THE INVENTION

This invention provides a color silver halide photographic element comprising a support having situated thereon a red light-sensitive cyan dye-forming unit comprising a photosensitive silver halide emulsion layer and an image dye-forming coupler; a green light-sensitive magenta dye-forming unit comprising a photosensitive silver halide emulsion layer and an image dye-forming coupler; and a blue light-sensitive yellow dye-forming unit comprising a photosensitive silver halide emulsion layer and an image dye-forming coupler; wherein at least one of the dye-forming units comprises two or more emulsion layers spectrally sensitized to the same region of the visible spectrum, but exhibiting different photographic sensitivities, each such emulsion layer containing an image dye-forming coupler wherein at least one, but not all, of the emulsion layers of the dye-forming unit contains the hydrolyzed or unhydrolyzed form of a benzazolium compound represented by Formula (I):

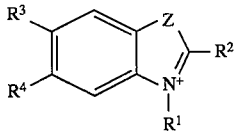

(I)

wherein

Z represents S, Se, or Te;

$R^1$ is an anionic substituted alkyl group of 1 to 4 carbon atoms;

R2 is an alkyl or aryl group or hydrogen; and $R^3$ and $R^4$ are individually selected from hydrogen atoms, halogen atoms; nitro groups; cyano groups; carboxy groups; alkyl or aryl groups; alkoxy groups; aryloxy groups, acylamino groups, sulfonamido groups; sulfamoyl groups; sulfamido groups; carbamoyl groups; diacylamino groups; aryloxycarbonyl groups; alkoxycarbonyl groups; alkoxysulfonyl groups; alkoxysulfonyl groups; alkylsulfonyl groups; arylsulfonyl groups; alkylthio groups; arylthio groups; alkoxycarbonylamino groups; aryloxycarbonylamino groups; alkylsulfoxyl groups; arylsulfoxyl groups; alkylureido groups; arylureido groups; alkylcarbonyl groups, arylcarbonyl groups, perfluroalkyl groups, acyl groups, thiocyano groups, heterocyclic groups and acyloxy groups. In one embodiment the photographic element is a reversal element. Generally, the dye-forming unit containing the benzazolium compound is the green light-sensitive, magenta dye-forming unit.

The benzazolium compounds represented by Formula I have been found to provide an advantageous speed increase during push processing. This is particularly surprising since the compounds do not increase speed under normal processing times. By incorporating this compound into one or more, but not all, of the silver halide emulsion layers in a color forming unit, selective control over the density region of a single color record during push processing can be achieved, thus optimizing color balance in the color photographic element.

DETAILED DESCRIPTION OF THE INVENTION

The benzazolium compounds of this invention which provide an advantageous speed increase during push processing are represented by Formula (I):

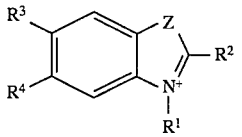

(I)

Z represents S, Se, or Te, most preferably S. $R^1$ is an anionic substituted alkyl group of 1 to 4 carbon atoms. The anionic substituent may be any anionic substituent which forms an inner salt with the benzazolium cation and maintains its anionic character after hydrolysis of the benzazolium ion and which does not destroy the intended function of the compound. Suitable anionic substituents include $SO_3^-$, $CO_2^-$ or $PO_3^-$.

$R^2$ is an alkyl or aryl group or hydrogen. $R^2$ can take the form of any substituent that is compatible with ring opening hydrolysis of the benzazolium compound. Preferably the alkyl group contains 1 to 8 carbon atoms (e.g. methyl, ethyl, propyl, i-propyl n-butyl, t-butyl or n-octyl)and the aryl group contains 6 to 10 carbon atoms (e.g. phenyl or naphthyl). More preferably $R^2$ is hydrogen or alkyl group having 1 to 4 carbon atoms or a phenyl group.

$R^3$ and $R^4$ are individually selected from hydrogen atoms, halogen atoms; nitro groups; cyano groups; carboxy groups; alkyl or aryl groups; alkoxy groups; aryloxy groups, acylamino groups, sulfonamido groups; sulfamoyl groups; sulfamido groups; carbamoyl groups; diacylamino groups; aryloxycarbonyl groups; alkoxycarbonyl groups; alkoxysulfonyl groups; aryloxysulfonyl groups; alkylsulfonyl groups; arylsulfonyl groups; alkylthio groups; arylthio groups; alkoxycarbonylamino groups; aryloxycarbonylamino groups; alkylsulfoxyl groups; arylsulfoxyl groups; alkylureido groups; arylureido groups; alkylcarbonyl groups; arylcarbonyl groups; perfluroalkyl groups; acyl groups; thiocyano groups; heterocyclic groups and acyloxy groups. These groups may be substituted or unsubstituted.

Preferably $R^3$ and $R^4$ are individually selected from hydrogen atoms or aryloxy or alkoxy groups of 1 to 20 carbon atoms and more preferably less than 10 carbon atoms. Most preferably at least one of $R^3$ or $R^4$ must be an alkoxy group.

Examples of suitable substituents $R^3$ and $R^4$ include halogen, such as chlorine, bromine or fluorine; alkyl or aryl groups, including straight, branched or cyclic alkyl groups, such as those containing 1 to 30 carbon atoms, for example methyl, trifluoromethyl, ethyl, t-butyl, phenyl, tetradecylphenyl, 4-t-butylphenyl, 2,4,6-trimethylphenyl and naphthyl; alkoxy groups, such as an alkoxy group containing 1 to 30 carbon atoms, for example methoxy, ethoxy, 2-ethylhexyloxy and tetradecyloxy; aryloxy groups, such as phenoxy, α- or β-naphthyloxy, and 4-tolyloxy; acylamino groups, such as acetamido, benzamido, butyramido, tetradecanamido, α-(2,4-di-t-amylphenoxy)acetamido, α-(2,4-di-t-amyl-phenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5-tetradecylpyrrolin-1-yl, N-methyltetradecanamido, and t-butylcarbonamido; sulfonamido groups, such as methanesulfonamido, benzenesulfonamido, p-toluenesulfonamido, p-dodecylbenzenesulfonamido, N-methyltetradecylsulfonamido, and hexadecanesulfonamido; sulfamoyl groups, such as N-methylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sufamido groups, such as N-methylsulfamido and N-octadecylsulfamido; carbamoyl groups, such as N-methylcarbamoyl, N-octadecylcarbamoyl, N-[4-(2,4-di-t-pentyl-phenoxy)butyl]carbamoyl, N-methyl-N-tetradecylcarbamoyl, and N,N-dioctylcarbamoyl; diacylamino groups, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl groups, such as phenoxycarbonyl and p-dodecyloxphenoxy carbonyl; alkoxycarbonyl groups, such as alkoxycarbonyl groups containing 2 to 30 carbon atoms, for example methoxycarbonyl, tetradecyloxycarbonyl, ethoxycarbonyl, benzyloxcarbonyl, and dodecyloxycarbonyl; alkoxysulfonyl groups, such as alkoxysulfonyl groups containing 1 to 30 carbon atoms, for example methoxysulfonyl, octyloxysulfonyl, tetradecyloxysulfonyl, and 2-ethylhexyloxysulfonyl; aryloxysulfonyl groups, such as phenoxysulfonyl, 2,4-di-t-amylphenoxysulfonyl; alkanesulfonyl groups, such as alkanesulfonyl groups containing 1 to 30 carbon atoms, for example methanesulfonyl, octanesulfonyl, 2-ethylhexanesulfonyl, and hexadecanesulfonyl; arenesulfonyl groups, such as benzenesulfonyl, 4-nonylbenzenesulfonyl, and p-toluenesulfonyl; alkylthio groups, such as alkylthio groups containing 1 to 22 carbon atoms; for example ethylthio, octylthio, benzylthio, tetradecylthio, and 2-(2,4-di-t-amylphenoxy)ethylthio; arylthio groups, such as phenylthio and p-tolylthio; alkoxycarbonylamino, such as ethoxycarbonylamino, benzyloxycarbonylamino, and hexadecyloxycarbonylamino; alkylureido groups, such as N-methylureido, N,N-dimethylureido, N-methyl-N-dodecylureido, N-hexadecylureido, N,N-dioctadecylureido, and N,N-dioctyl-N'-ethyl-ureido; acyloxy groups, such as acetyloxy, benzoyloxy, octadecanoyloxy, p-dodecanamidobenzoyloxy, and cyclohexanecarbonyloxy; nitro groups; cyano groups; carboxy groups and heterocyclic groups including 3- to 15-membered rings with at least one atom selected from nitrogen, oxygen, sulfur, selenium and tellurium such as pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings; where preferably the foregoing organic substituents contain not more than 10 and more preferably not more than 5 carbon atoms. It is desired that the benzazolium compounds be soluble in an aqueous solvent. In one particularly suitable embodiment $R^3$ and $R^4$ are methoxy, $R^2$ is hydrogen and $R^1$ is $CH_2CH_2SO_3^-$.

As reported in the literature, e.g., A. H. Herz, "Chemical Factors for the Control of Silver Halide Recrystallization and Growth" in "The Journal of Imaging Science and Technology" Vol 39 No 1 pp 40 55(1995) FIG. 14, benzazolium salts undergo hydrolysis at conditions usually employed in emulsion preparation such as high pH(>3) and elevated temperatures(>25 C.) as shown below.. Such conditions may also be present during processing.

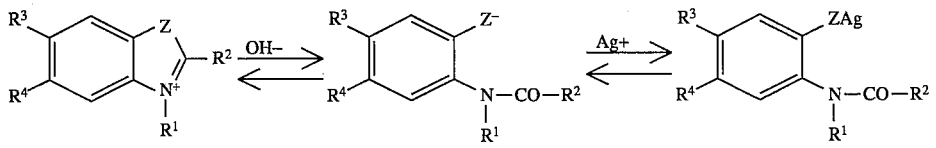

(I) (II) (III)

This hydrolysis reaction converts benzazolium salt (I) to an intermediate (II) and to a final silver salt (III). It is understood that the photographic elements of the present invention contain any form of the benzazolium salts of this invention, (hydrolyzed or unhydrolyzed) depending on how and when the benzazolium compounds were added during preparation of the emulsion or how the elements were processed.

The color silver halide photographic element of the invention can have any of the image forming or non-imaging forming layers known in the art. The photographic element is a multilayer, multicolor element. Most preferably it is a reversal photographic element. A multicolor element contains dye image-forming units sensitive to each of the three primary regions of the visible light spectrum. Each unit can be comprised of a single emulsion layer, or of multiple emulsion layers spectrally sensitive to the same or substantially the same region of the spectrum. The layers of the element, can be arranged in various orders as known in the art.

In this invention the multicolor photographic element comprises a support having situated thereon, preferably in order from the support, a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler. At least one of the dye-forming units of the photographic element must comprise two or more emulsion layers spectrally sensitized to the same region of the visible spectrum, but exhibiting different photographic sensitivities, with each such emulsion layer containing an image dye-forming coupler. By photographic sensitivity, it is meant what is known in the art as photographic speed. At least one, but not all, of the emulsion layers of the dye-forming unit comprising two or more emulsion layers must contain the hydrolyzed or unhydrolyzed form of the benzazolium compound represented by Formula (I).

The compound of Formula (I) may be contained in more than one dye-forming unit of a photographic element, however it cannot be present in every emulsion layer within the same unit. Preferably the benzazolium compound is not contained in the least sensitive emulsion layer of the dye-forming unit. For improved granularity the least sensitive emulsion layer of a color reversal element is often coated with a large excess of silver halide relative to the coupler in that layer. Consequently, changes in the development of this layer result in only very small changes in the dye scale and so little effect of benzazolium compound may be seen. Further, in a reversal photographic element, very low density regions do not require increased speed at push because of the effect of solution physical development on the slow emulsion. On the others hand, use of the benzazolium compound in one or more of the more sensitive emulsion layers permits density-specific acceleration of push processing whereby one skilled in the art may correct color balance in one region of the densitometric curve with minimal change elsewhere. In order to affect only certain portions of the curve, the compound should not be utilized in all the layers. Generally, only one color forming unit in a photographic element contains the compounds represented by Formula (I).

Preferably the dye-forming unit containing the benzazolium compound is the green light-sensitive, magenta dye-forming unit. In one embodiment the green light-sensitive, magenta dye-forming unit comprises a slow, middle and fast silver halide emulsion layer and the middle layer contains the benzazolium compound of Formula (I).

Useful levels of the compounds range from 0.1 micromoles to 10,000 micromoles per silver mole. The preferred range is from 1 micromole to 5,000 micromoles per silver mole with a more preferred range being from 5 micromoles to 1000 micromoles per silver mole. The most preferred range is from 10 micromoles to 500 micromoles per silver mole.

The compounds may be added to the photographic emulsion using any technique suitable for this purpose. They may be dissolved in any suitable aqueous solvent such as water, alcohol, or their mixtures. Combinations of more than one benzazolium compound of Formula (I) may be utilized.

Photographic emulsions are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. Preferably, the emulsion is sensitized both with gold and a chalcogenide, most preferably gold and sulfur. Examples of sulfur sensitizers include sodium thiosulfate, alkyl or aryl thiourea compounds, or thiourea compounds with nucleophilic substituents as described in U.S. Pat. No. 4,810,626. Examples of gold sensitizers include potassium tetrachloroaurate, potassium dithiocyanato gold (I), trisodium dithiosulfato gold(I), and the gold(I) compounds described in U.S. Pat. Nos. 5,049,484; 5,049,485; 5,252,455; 5,220,030; and 5,391,727. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, bead coating, curtain coating and extrusion coating.

The compounds of this invention may be added to the silver halide emulsion at any time during the preparation of the emulsion, i.e., during precipitation, during or before chemical sensitization or during final melting and co-mixing of the emulsion and additives for coating. More preferably, these compounds are added during or after chemical sensitization, and most preferably during chemical sensitization.

In one embodiment of the invention at least one of the emulsion layers of the dye-forming unit containing the benzazolium compound of Formula (I), also contains a benzazolium salt represented by Formula (II) with the proviso that the compound of Formula (I) and the compound of Formula (II) are not contained in the same emulsion layer.

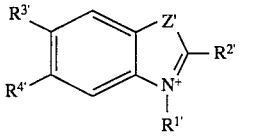

(II)

In Formula (II) Z', $R^{2'}$, $R^{3'}$ and $R^{4'}$ are as similarly defined for Z, $R^2$, $R^3$ and $R^4$ for Formula (I) respectively. $R^{1'}$ is an unsubstituted or nonionic substituted alkyl group of 1 to 4 carbon atoms. The nonionic substituent must not form any inner salt with the benzazolium cation and must maintain its nonionic character after hydrolysis of the benzazolium ion. It further must not interfere with the intended use of the compound. Preferably the nonionic substituent is $$—T\text{-}(NH—T')_m R$$

wherein T and T' are independently carbonyl or sulfonyl. Where m is more than 1, T' can in each occurrence be carbonyl or sulfonyl independently of other occurrences. m is an integer from 1 to 3; more preferably m is 1.

R is an optionally substituted hydrocarbon residue or an amino group. R is preferably a primary or secondary amino group, an alkyl group of from 1 to 8 carbon atoms (e.g. methyl, ethyl, propyl, i-propyl n-butyl, t-butyl or n-octyl) or an aryl group of from 6 to 10 carbon atoms (e.g. phenyl or naphthyl). $X^-$ is an appropriate anion. Suitable examples of $X^-$ include, but are not limited to: halide ions, para-toluene sulfonate, $NO_3^-$, $ClO_4^-$, methylsulfate ion or $BF_4^-$.

In one preferred embodiment the compound of Formula II is 3-(methylsulfamoylethyl)-benzothiazolium salt with tetra fluoroborate as the anion.

The compounds represented by Formula (II) may be added to the emulsion layers of a dye-forming unit using the methods and amounts described for the compounds represented by Formula (I). The compounds represented by Formula (II) are generally added to the least sensitive layer of the dye-forming unit although they may be added to the other layers provided they are not added to the emulsion layer or layers containing the compounds represented by Formula (I). Preferably these compounds are utilized in the green light-sensitive, magenta dye-forming unit. In one embodiment the green light-sensitive, magenta dye-forming unit comprises a slow, middle and fast silver halide emulsion layer and the middle layer contains the benzazolium compound of Formula I and a compound of Formula (II) is added to the slow silver halide layer.

In a particularly preferred embodiment of the invention, the layers in which compounds of Formula (I) and compounds of Formula (II) are coated contain a development accelerator or inhibitor, or a precursor thereof. Suitable development accelerators and inhibitors are described in U.S. Pat. Nos. 3,535,487; 5,041,367; 5,460,932; and *Research Disclosure* December 1989, Item 08119, Sections XXI B-D and *Research Disclosure*, September 1994, Item 36544, Section XVIII 5–10.

It is understood throughout this specification and claims that any reference to a substituent by the identification of a group containing a substitutable hydrogen (e.g., alkyl, amine, aryl, alkoxy, heterocyclic, etc.), unless otherwise specifically described as unsubstituted or as substituted with only certain substituents, shall encompass not only the substituent's unsubstituted form but also its form substituted with any substituents which do not negate the advantages of this invention. Examples of substituents are as described for $R^3$ and $R^4$. Furthermore, any reference to an alkyl group includes cyclic groups.

In one embodiment of this invention there is a layer containing colloidal silver and/or yellow filter dyes, or a combination thereof, between the blue light-sensitive, yellow dye-forming unit and the green light-sensitive, magenta dye-forming unit of the silver halide photographic element. Suitable dyes include those described in U.S. Pat. Nos. 2,538,008; 2,538,009; 4,420,555; 4,950,586; 4,948,718; 4,948,717; 4,940,654; 4,923,788; 4,900,653; 4,861,700; 4,857,446; 4,855,221, 5,213,956, 5,213,957 and 5,298,377; U.K. Patents 695,873 and 760,739; European Patent Application 430,186; and Provisional Application Serial No. 60/001, 801 entitled "Photographic Element Comprising A Novel Filter Dye" filed Jul. 27, 1995, all incorporated herein by reference. In another embodiment there is an interlayer positioned between the blue light-sensitive, yellow dye-forming unit and the layer containing colloidal silver or yellow filter dye. Such a layer can also be between the green light-sensitive layer and a layer containing colloidal silver or between the red light-sensitive layer and a layer containing colloidal silver, or any combination thereof.

In the photographic element, the interlayer positioned as described above can be any hydrophilic colloidal layer known in the art. It may therefore comprise gelatin (e.g. ossein) or gelatin derivatives. Other specific suitable hydrophilic colloid materials which can be used alone or in combination include cellulose derivatives, potysaccharides such as dextran, gum arabic and the like; synthetic polymeric substances such as water soluble polyvinyl compounds like poly(vinylpyrrolidone), acrylamide polymers and the like. Other materials are described in U.S. Pat. No. 5,298,369 and *Research Disclosure* December 1989 Item 308119, par. IXA, which are incorporated herein by reference.

The interlayer may be characterized in that it typically is coated at levels between 260 and 2200 mg gelatin/$m^2$; and preferably at levels between 500 and 1000 mg gelatin/$m^2$. As noted, it is positioned closer to the blue light-sensitive unit than the second layer; and it is preferably positioned immediately adjacent to such blue light-sensitive unit.

The interlayer may contain additional additives such as thickening agents, surfactants, hardeners, couplers, oxidized developing agent scavengers, development inhibitors, development accelerators, absorbing dyes, and the like. These compounds may be added in amounts and by methods known in the art. This interlayer typically will not contain colloidal silver.

The interlayer preferably contains an oxidized developing agent scavenger. Exemplary scavengers of this type include disulfonamidophenols and the ballasted or otherwise non-diffusing antioxidants illustrated in U.S. Pat. Nos 2,336,327; 2,728,659; and 2,403,721, all of which are incorporated herein by reference. Others are described in *Research Disclosure* December 1989 Item 308119, par. VII.I, and *Research Disclosure*, September 1994, Item 36544, par X.D which are incorporated herein by reference. It is preferred that the scavenger be incorporated into the layer in an amount from 10–1,000 mg/$m^2$; preferably an amount from 50–200 mg/$m^2$; and optimally an amount from 75–125 mg/$m^2$.

The colloidal silver layer can also be selected from those layers known in the art. Colloidal silver may be any colloidal elemental silver of the types commonly employed in the photographic arts. For example, it may be yellow colloidal silver, i.e. Carey Lea silver, or black or gray/black colloidal silver. In general, such silver colloids contain silver particles having a size within the range from about 50 to about 100 angstroms. The silver colloids are generally formed in gelatin or other hydrophilic colloids of the type described above. For example, Carey Lea silver is generally prepared by a process comprising silver reduction in a basic solution obtained by reacting dextrin and silver nitrate. In many instances, phthlated gelatin is added to facilitate washing of the silver product.

For the purposes of the invention, a level of colloidal silver sufficient to achieve an advantageous color balance in the mid scale (D=0.6 to 1.4) region is used. Typically, the level of colloidal silver will be in the range of from 5 to 500 mg/$m^2$. More typically, it will be in the range of from 25 to 250 mg/$m^2$, and usually it will be in the range of from 50 to 150 mg/$m^2$.

Other additives may be added to the colloidal silver layer. They can be any of the additives described above for addition to the first layer. The compounds may be added in amounts and by methods known in the art.

The element may contain layers in addition to those described above. Such layers include filter layers, in particularly yellow and magenta filter dye layers, interlayers, overcoat layers, subbing layers, and the like. The photographic elements may also contain a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994(Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

The silver halide emulsion employed in the dye-forming units of the invention can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Particularly preferred are grains having a tabular morphology. Preferably, such tabular grains have a Tabularity (defined as a grain's equivalent circular diameter microns divided by the square of its thickness) greater than 10, and more preferably greater than about 25.

The silver halide emulsion can be either monodisperse or polydisperse as precipitated. The grain size distribution of the emulsion can be controlledby silver halide grain separation techniques or by blending silver halide emulsions of differing grain sizes.

The grains may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. In accordance with the invention, it is preferred that the grains in each of the dye-forming units contain at least 75%, more preferably at least 90%, and optimally entirely silver bromoiodide. The iodide content in such emulsions is preferably from 1 to 15 mole percent, preferably 2 to 6 mole percent, and optimally 2 to 4 mole percent.

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin)—or acid treated gelatin (pigskin gelatin). and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film).

In a typical construction, a reversal film does not have any masking couplers. Furthermore, reversal films have a gamma generally between 1.5 and 2.0, a gamma which is much higher than the gamma for typical negative materials.

In the following Table, reference will be made to (1)*Research Disclosure*, December 1978, Item 17643, (2)*Research Disclosure*, December 1989, Item 308119, (3)*Research Disclosure*, September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the photographic element of the invention. The Table and its cited references also describe suitable ways of exposing, processing and manipulating the elements, and the images contained therein. Components which are particularly suitable for use in the photographic element of the invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Generic system Element(s) |
|---|---|---|
| 1 | I, II | Grain composition, |
| 2 | I, II, IX, X, XI, XII, XIV, XV | morphology and preparation; Emulsion preparation including hardeners, |
| 3 | I, II, III, IX A & B | coating aids, addenda, etc. |
| 1 | III, IV | Chemical |
| 2 | III, IV | sensitization and |
| 3 | IV, V | spectral sensitization/ desensitization |
| 1 | V | UV dyes, optical |
| 2 | V | brighteners, |
| 3 | VI | luminescent dyes |
| 1 | VI | Antifoggants and |
| 2 | VI | stabilizers |
| 3 | VII | |
| 1 | VIII | Absorbing and |
| 2 | VIII, XIII, XVI | scattering materials; |
| 3 | VIII, IX C & D | Antistatic layers; matting agents |
| 1 | VII | Image-couplers and |
| 2 | VII | image-modifying |
| 3 | X | couplers; Dye stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylenenapthalates)), paper and polymer coated paper. Such supports are described in further detail in *Research Disclosure* 3, Section XV.

The photographic elements may also contain additional materials that accelerate or otherwise modify the processing steps of bleaching or fixing to improve the quality of the image. Bleach accelerators described in European Patent Applications No. 193,389 and 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Pat. No. 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol and/or yellow and/or magenta filter dyes, either as oil-in-water dispersions, latex dispersions or as solid particle dispersions. Additionally, they may be used with "smearing" couplers (e.g. as described in U.S. Pat. No. 4,366,237; European Patent Application 96,570; U.S. Pat. Nos. 4,420,556; and 4,543,323.) Also, the couplers may be blocked or coated in protected form as described, for example, in Japanese Application 1/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. DIRs that have particular application in color reversal elements are disclosed in U.S. Pat. Nos. 5,399,465; 5,380,633; 5,399,466; and 5,310,642.

It is also contemplated that the concepts of the present invention may be employed to obtain reflection color prints. The emulsions and materials to form elements of the present invention, may be coated on pH adjusted support as described in U.S. Pat. No. 4,917,994; with epoxy solvents (European Patent Application 0 164 961); with additional stabilizers (as described, for example, in U.S. Pat. No. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586 62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093663; 90-093,664; 90-093,665; 90-093,666; 90-093,668; 90-094,055; 90-094,056; 90-101,937; 90-103,409; 90-151,577.

The silver halide grains to be used in the invention may be prepared according to methods known in the art, such as those described in *Research Disclosure* 3 and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure* 3 and the references cited therein.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure* 3. Examples of dyes include dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, stryryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating.

Photographic elements of the present invention can be imagewise exposed using any of the known techniques, including those described in *Research Disclosure* 3. This typically involves exposure to light in the visible region of the spectrum, and typically such exposure is of a live image through a lens. However, the photographic elements of the present invention may be exposed in a film writer as described above. Exposure in a film writer is an exposure to a stored image (such as a computer stored image) by means of light emitting devices (such as light controlled by light valves, CRT and the like).

Preferably the photographic elements comprising the composition of the invention are color reversal elements. These may be processed in any color reversal process. Such processes, as described above, require first treating the element with a black and white developer, followed by fogging non-exposed grains using chemical or light fogging, followed by treatment with a color developer.

Preferred non-chromogenic developers (that is, black and white developers) are hydroquinones (such as hydroquinone sulphonate).

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido-)ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluene di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in *Research Disclosure* 3.

The photographic elements can be incorporated into exposure structures intended for repeated use or exposure structures intended for limited use, variously referred to as single use cameras, lens with film, or photosensitive material package units. However, the color reversal elements of the present invention can also be used by exposing in an electronic film writer (such film writers typically expose the film by laser, laser diode, or some other controlled light source).

The practice of the invention is described in detail below with reference to specific illustrative examples, but the invention is not to be construed as being limited thereto.

EXAMPLE

Example 1

The invention was demonstrated in a green light-sensitive magenta dye-forming layer which requires more speed upon pushing within a multilayer photographic element. The green light-sensitive layer was triple layer coated utilizing a most sensitive layer (FM), a medium sensitive layer (MM) and a least sensitive layer (SM) in a conventional color reversal multi-color element. Particularly the invention was demonstrated in the most sensitive and medium sensitive green light-sensitive layers.

All of the imaging emulsions were tabular AgBrI grains doped with iridium. The iodide content, grain size(equivalent circular diameter (ECD)), mean thickness in micrometers(t) and mean tabularity in micrometers(T) of the green light-sensitive emulsions were as shown below:

| Emulsion | mole % I | ECD | t | T |
|---|---|---|---|---|
| FM A | 2 | 1.2 | 0.13 | 71 |
| MM B | 3 | 0.6 | 0.11 | 50 |
| SM C | 4 | 0.3 | 0.075 | 53 |

The least green light-sensitive emulsion(C) was sensitized with 94 micromoles/Ag mole BTA-II selected from Formula (II). The most and medium green light-sensitive emulsions were sensitized with BTA-I selected from Formula (I) and compared with BTA-II to show the invention. Green light-sensitive emulsions A and B were optimally sensitized using the following sensitizers:

S-i: 4,5-dihydroxy benzene-1,3-disulfonic acid, disodium salt

S-2: P-acetamidophenyl disulfide

S-3: Sodium thiocyanate

S-4: see formula

S-5: see formula

S-6: trisodium dithiosulfato gold(I)

S-7: sodium thiosulfate

Emulsions A-1 through A-5 and Emulsions B-1 through B-3 were prepared from Emulsions A and B by the addition of varying levels and kinds of benzazolium salts as sensitizers. The benzazolium compounds were added during chemical sensitization before heat digestion.

| Emulsion No. | | Benzazolium Salts (micromoles/Ag mole) |
|---|---|---|
| FM | A-1 | none(0) |
| FM | A-2 | BTA-I(21) |
| FM | A-3 | BTA-I(43) |
| FM | A-4 | BTA-I(64) |
| FM | A-5 | BTA-II(49) |
| MM | B-1 | BTA-II(94) |
| MM | B-2 | BTA-I(82) |
| MM | B-3 | BTA-I(164) |

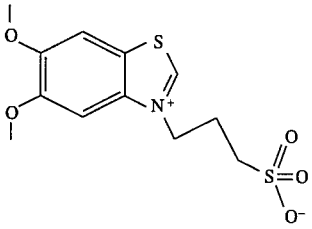

BTA-I

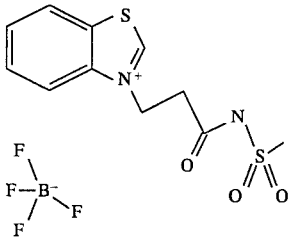

BTA-II

-continued

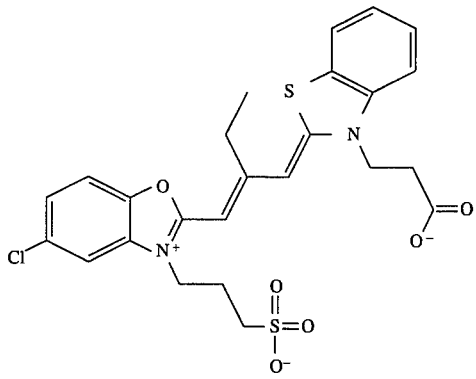

S-5

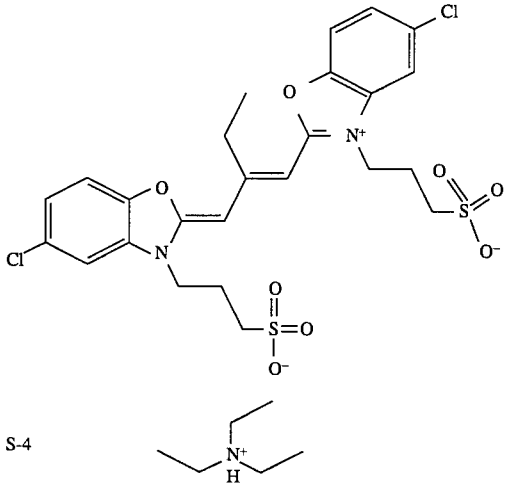

S-4

Samples 101 to 106 were prepared using a cellulose triacetate film support provided with a subbing layer. Each sample was coated as shown below with the only variation being in the type of Emulsion A or B which was coated in the mid or fast magenta layers (green light sensitive layers).

In the composition of the layers, the coating amounts are shown as gm/m2.

| | |
|---|---|
| First layer: Antihalation Layer | |
| Black Colloidal Silver | 0.43 (as silver) |
| Gelatin | 2.44 |
| Second layer: Intermediate Layer | |
| Gelatin | 1.22 |
| Third layer: Slow Red Sensitive layer | |
| Silver Iodobromide Emulsion | 0.32 (as silver) |
| Fine Grain Silver Bromide | 0.05 (as silver) |
| Cyan coupler C-1 | 0.12 |
| Solvent-2 | 0.06 |

-continued

| | |
|---|---|
| Gelatin | 1.08 |
| Fourth layer: Mid Red Sensitive Layer | |
| Silver Iodobromide Emulsion | 0.28 (as silver) |
| Fine Grain Silver Bromide | 0.04 (as silver) |
| Cyan coupler C-1 | 0.36 |
| Solvent-2 | 0.18 |
| Gelatin | 0.65 |
| Fifth layer: Fast Red Sensitive Layer | |
| Silver Iodobromide Emulsion | 0.48 (as silver) |
| Fine Grain Silver Iodobromide | 0.05 (as silver) |
| Fine Grain Silver Bromide | 0.03 |
| Cyan coupler C-1 | 0.78 |
| Solvent-2 | 0.39 |
| Gelatin | 1.28 |
| Sixth layer: Magenta Filter Layer | |
| Competitor-1 | 0.16 |
| Solvent-2 | 0.16 |
| Dye-1 | 0.06 |
| Gelatin | 0.81 |
| Seventh layer: Intermediate Layer | |
| Addendum-2 | 0.001 |
| Gelatin | 0.61 |
| Eighth layer: Slow Green Sensitive layer (SM) | |
| Silver Iodobromide Emulsion C | 0.35 (as silver) |
| Fine Grain Silver Bromide | 0.05 (as silver) |
| Coupler M-2 | 0.04 |
| Coupler M-1 | 0.08 |
| Solvent-1 | 0.06 |
| Gelatin | 0.52 |
| Ninth layer: Mid Green Sensitive Layer (MM) | |
| Silver Iodobromide Emulsion B as shown in Table 1 | 0.36 (as silver) |
| Coupler M-2 | 0.15 |
| Coupler M-1 | 0.34 |
| Solvent-1 | 0.25 |
| Gelatin | 0.86 |
| Tenth layer: Fast Green Sensitive Layer (FM) | |
| Silver Iodobromide Emulsion A as shown in Table 1 | 0.50 (as silver) |
| Fine Grain Silver Iodobromide | 0.04 (as silver) |
| Coupler M-2 | 0.29 |
| Coupler M-1 | 0.69 |
| Solvent-1 | 0.49 |
| Gelatin | 1.64 |
| Eleventh layer: Intermediate Layer | |
| Gelatin | 0.61 |
| Twelfth layer: Yellow Filter Layer | |
| Carey Lea Silver | 0.07 |
| Gelatin | 0.68 |
| Thirteenth layer: Intermediate Layer | |
| Competitor-1 | 0.11 |
| Gelatin | 0.61 |
| Fourteenth layer: Slow Blue Sensitive Layer | |
| Silver Iodobromide Emulsion | 0.43 (as silver) |
| Coupler Y-1 | 0.98 |
| Addendum-1 | 0.004 |
| Solvent-2 | 0.33 |
| Solvent-3 | 0.01 |
| Gelatin | 1.43 |
| Fifteenth layer: Fast Blue Sensitive Layer | |
| Silver Iodobromide Emulsion | 0.57 (as silver) |
| Coupler Y-1 | 1.45 |
| Addendum-1 | 0.003 |
| Solvent-2 | 0.44 |
| Solvent-3 | 0.01 |
| Gelatin | 1.87 |
| Sixteenth layer: First Protective Layer | |
| Competitor-1 | 0.06 |
| Gelatin | 1.40 |

-continued
| | |
|---|---|
| Ultraviolet Absorbing Dyes | 0.50 |
| Seventeenth layer: Second Protective Layer | |
| Fine Grain Silver Bromide | 0.12 (as silver) |
| Matte | 0.02 |
| Bix(vinyl sulfonyl methane) | 0.26 |
| Gelatin | 0.97 |
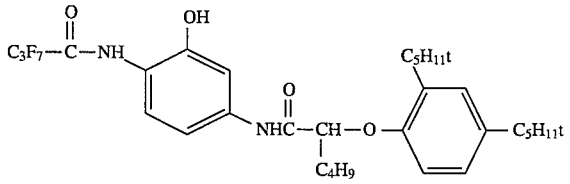
cyan coupler - C-1
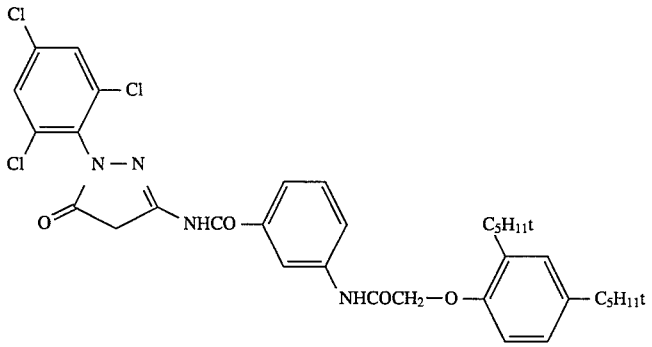
magenta coupler - M-1
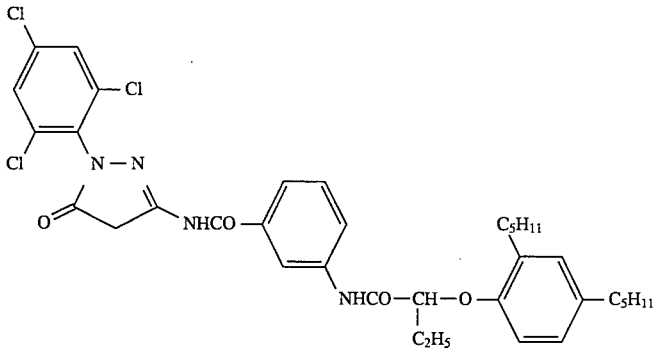
magenta coupler - M-2
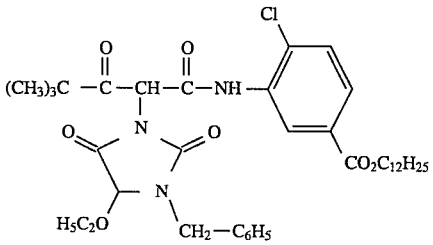
yellow coupler - Y-1
Solvent-1 di-n-butyl phthalate
Solvent-2 tricresyl phosphates
Solvent-3 N,N-diethyl lauramide -continued

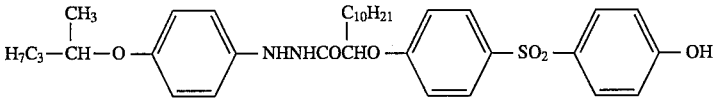

Competitor-1

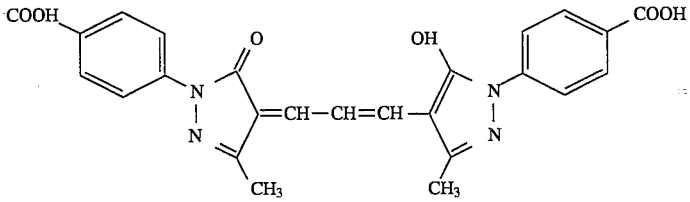

Dye-1

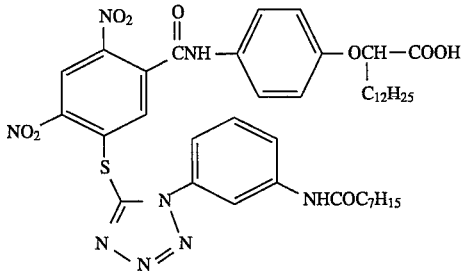

Addendum-1

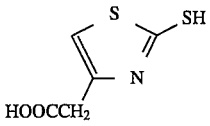

Addendum-2

TABLE 1

Speed at 6 minute TOD* and Change in Speed upon Push Processing (11 minute compared to 6 minute TOD) at Varying Densities

| | | | | D = 0.5 | | D = 1.0 | | D = 1.6 | | D = 2.2 | |
|---|---|---|---|---|---|---|---|---|---|---|---|
| Sample | FM | MM | | Speed at 6' | ΔSpeed of (11'–6') | Speed at 6' | ΔSpeed of (11'–6') | Speed at 6' | ΔSpeed of (11'–6') | Speed at 6' | ΔSpeed of (11'–6') |
| 101 | A-1 | B-1 | comparison | 41 | 52 | 80 | 42 | 116 | 32 | 143 | 31 |
| 102 | A-2 | B-1 | invention | 42 | 53 | 81 | 42 | 114 | 35 | 142 | 34 |
| 103 | A-4 | B-1 | invention | 40 | 52 | 76 | 44 | 111 | 36 | 140 | 36 |
| 104 | A-4 | B-3 | invention | 36 | 57 | 74 | 47 | 111 | 37 | 140 | 37 |
| 105 | A-1 | B-3 | invention | 38 | 54 | 77 | 45 | 115 | 33 | 143 | 31 |
| 106 | A-1 | B-2 | invention | 40 | 55 | 79 | 44 | 116 | 33 | 144 | 29 |

*Time of First Development

As can be seen from Table 1 above the photographic elements of the invention did not show increased speed in the green light-sensitive layers at the normal processing time of 6 minutes. At 11 minutes of development, however, the inventive samples show an increased change in speed at one or more densities in the green light-sensitive layer over the comparative samples. The change in speed upon push processing is specific to the emulsion layer containing the invention. The addition of BTA-I to the most sensitive layer to green light (Samples 102 and 103) causes high density to gain speed, while addition to the medium sensitive layer to green light (Samples 105 and 106) causes mid to lower densities to accelerate. The addition of BTA-I to both the most sensitive and the medium sensitive layers to green light (Sample 104) causes speeds at most densities to increase upon push processing.

Example 2

Samples 201 through 204 and Samples 301 to 307 were prepared and processed as described in Example 1 except for the eighth, ninth and tenth layers (the magenta or green light-sensitive layers) which were coated as shown below.

| | |
|---|---|
| Eighth Layer: Slow Green light Light-sensitive Layer | |
| Silver Iodobromide Emulsion C | 0.36 g/m2 (as silver) |
| Silver Bromide Lippman Emulsion | 0.05 g/m2 |
| Coupler M-2 | 0.04 g/m2 |
| Coupler M-1 | 0.08 g/m2 |
| Solvent-1 | 0.06 g/m2 |
| Gelatin | 0.54 g/m2 |
| Ninth Layer: Medium Green light Light-sensitive Layer | |
| Silver Iodobromide Emulsion B as shown in Tables 2 or 3 | 0.36 g/m2 (as silver) |
| Coupler M-2 | 0.16 g/m2 |
| Coupler M-1 | 0.32 g/m2 |
| Solvent-1 | 0.24 g/m2 |
| Gelatin | 0.86 g/m2 |
| Tenth Layer: Fast Green light Light-sensitive Layer | |
| Silver Iodobromide Emulsion C as shown in Tables 2 or 3 | 0.47 g/m2 (as silver) |
| Fine Grain Iodobromide Emulsion | 0.04 g/m2 (as silver) |
| Coupler M-2 | 0.33 g/m2 |
| Coupler M-1 | 0.66 g/m2 |
| Solvent-1 | 0.50 g/m2 |
| Gelatin | 1.66 g/m2 |

however, the inventive samples show an increased change in speed at one or more densities in the green light-sensitive layers over the comparative samples. Also demonstrated is the selective and specific nature of the increased speed obtained upon push processing depending on the layers in which the inventive compound of Formula (I) was employed.

The invention has been described in detail with particular reference to the preferred embodiments thereof, but it will be understood that variations and modifications can be effected within the scope of the invention.

What is claimed is:

1. A color silver halide photographic element comprising a support having situated thereon a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; wherein at least one of the dye-forming units comprises two or more emulsion layers spectrally sensitized to the same region of the visible spectrum, but exhibiting different photographic sensitivities, each such emulsion layer containing an image dye-forming coupler wherein at least one, but not all, of the emulsion layers of the dye-forming unit contains the hydrolyzed or unhydrolyzed form of a benzazolium compound represented by Formula (I):

TABLE 2

Speed at 6 minute TOD* and Change in Speed upon Push Processing (11 minute compared to 6 minute TOD) at Varying Densities

| | | | | D = 0.3 | | D = 0.5 | | D = 1.0 | | D = 1.6 | | D = 2.2 | |
|---|---|---|---|---|---|---|---|---|---|---|---|---|---|
| Sample | FM | MM | | Speed at 6' | ΔSpeed of (11'–6') | Speed at 6' | ΔSpeed of (11'–6') | Speed at 6' | ΔSpeed of (11'–6') | Speed at 6' | ΔSpeed of (11'–6') | Speed at 6' | ΔSpeed of (11'–6') |
| 201 | A-1 | B-1 | comparison | 16 | 63 | 45 | 52 | 87 | 41 | 124 | 33 | 155 | 32 |
| 202 | A-1 | B-2 | invention | 14 | 65 | 43 | 55 | 86 | 44 | 126 | 31 | 156 | 29 |
| 203 | A-3 | B-2 | invention | 13 | 67 | 44 | 55 | 86 | 45 | 125 | 35 | 156 | 35 |
| 204 | A-3 | B-1 | invention | 17 | 62 | 46 | 51 | 87 | 41 | 124 | 33 | 155 | 34 |

*Time of First Development

TABLE 3

Speed at 6 minute TOD* and Change in Speed upon Push Processing (11 minute compared to 6 minute TOD) at Varying Densities

| | | | | D = 0.3 | | D = 0.5 | | D = 1.0 | | D = 1.6 | | D = 2.2 | |
|---|---|---|---|---|---|---|---|---|---|---|---|---|---|
| Sample | FM | MM | | Speed at 6' | ΔSpeed of (11'–6') | Speed at 6' | ΔSpeed of (11'–6') | Speed at 6' | ΔSpeed of (11'–6') | Speed at 6' | ΔSpeed of (11'–6') | Speed at 6' | ΔSpeed of (11'–6') |
| 301 | A-1 | B-1 | comparison | 25 | 65 | 56 | 55 | 101 | 39 | 136 | 29 | 162 | 29 |
| 302 | A-3 | B-1 | invention | 25 | 65 | 55 | 56 | 100 | 41 | 135 | 34 | 165 | 39 |
| 303 | A-3 | B-2 | invention | 18 | 71 | 51 | 59 | 98 | 43 | 137 | 33 | 168 | 40 |
| 304 | A-5 | B-1 | comparison | 23 | 68 | 55 | 56 | 100 | 40 | 136 | 30 | 164 | 31 |
| 305 | A-1* | B-1 | comparison | 27 | 64 | 58 | 54 | 103 | 38 | 136 | 28 | 161 | 26 |
| 306 | A-3* | B-1 | invention | 25 | 67 | 55 | 57 | 99 | 42 | 135 | 32 | 162 | 33 |
| 307 | A-3* | B-2 | invention | 20 | 70 | 50 | 60 | 99 | 42 | 137 | 31 | 165 | 34 |

* = 7.5% reduction of sensitizers and dyes relative to normal (A-1)
**Time of First Development Tables 2 and 3 present evidence that the photographic elements of the invention again did not show increased speed in the green light-sensitive layers at the normal processing time of 6 minutes. At 11 minutes of development,

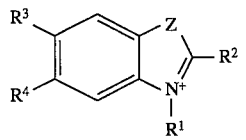

(I)

wherein

Z represents S, Se, or Te;

$R^1$ is an anionic substituted alkyl group of 1 to 4 carbon atoms;

R2 is an alkyl or aryl group or hydrogen; and $R^3$ and $R^4$ are individually selected from hydrogen atoms, halogen atoms; nitro groups; cyano groups; carboxy groups; alkyl or aryl groups; alkoxy groups; aryloxy groups, acylamino groups, sulfonamido groups; sulfamoyl groups; sulfamido groups; carbamoyl groups; diacylamino groups; aryloxycarbonyl groups; alkoxycarbonyl groups; alkoxysulfonyl groups; aryloxysulfonyl groups; alkylsulfonyl groups; arylsulfonyl groups; alkylthio groups; arylthio groups; alkoxycarbonylamino groups; aryloxycarbonylamino groups; alkylsulfoxyl groups; arylsulfoxyl groups; alkylureido groups; arylureido groups; alkylcarbonyl groups; arylcarbonyl groups; perfluroalkyl groups; acyl groups; thiocyano groups; heterocyclic groups and acyloxy groups.

2. The photographic element of claim 1 wherein the photographic element is a reversal element.

3. The photographic element of claim 1 wherein the dye-forming unit containing the benzazolium compound is the green light-sensitive, magenta dye-forming unit.

4. The photographic element of claim 1 wherein the benzazolium compound is not contained in the least sensitive emulsion layer of the dye-forming unit.

5. The photographic element of claim 1 wherein $R^3$ and $R^4$ are individually selected from hydrogen atoms or alkoxy or aryloxy groups of 1 to 20 carbon atoms.

6. The photographic element of claim 1 wherein the anionic substituent on $R^1$ is $SO_3$—, $CO_2$— or $PO_3$—.

7. The photographic element of claim 1 wherein $R^2$ is hydrogen, an alkyl group of 1 to 4 carbon atoms or a phenyl group.

8. The photographic element of claim 1 wherein $R^3$ and $R^4$ are methoxy, $R^2$ is hydrogen and $R^1$ is $CH_2CH_2SO_3$—.

9. The photographic element of claim 1 wherein at least one of the emulsion layers of the dye-forming unit containing the benzazolium compound of Formula (I), also contains a benzazolium salt represented by Formula (II):

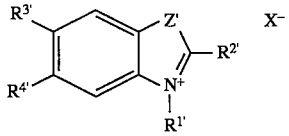

(II)

wherein

Z' represents S, Se, or Te;

$R^{1'}$ is an unsubstituted or nonionic substituted alkyl group of 1 to 4 carbon atoms;

R2' is an alkyl or aryl group or hydrogen;

$R^{3'}$ and $R^{4'}$ are individually selected from hydrogen atoms, halogen atoms; nitro groups; cyano groups; carboxy groups; alkyl or aryl groups; alkoxy groups; aryloxy groups, acylamino groups, sulfonamido groups; sulfamoyl groups; sulfamido groups; carbamoyl groups; diacylamino groups; aryloxycarbonyl groups; alkoxycarbonyl groups; alkoxysulfonyl groups; aryloxysulfonyl groups; alkylsulfonyl groups; arylsulfonyl groups; alkylthio groups; arylthio groups; alkoxycarbonylamino groups; aryloxycarbonylamino groups; alkylsulfoxyl groups; arylsulfoxyl groups; alkylureido groups; arylureido groups; alkylcarbonyl groups; arylcarbonyl groups; perfluroalkyl groups; acyl groups; thiocyano groups; heterocyclic groups and acyloxy groups; and X is an appropriate anion; with the proviso that the compound of Formula (I) and the compound of Formula (II) are not contained in the same emulsion layer.

10. The Photographic element of claim 9 wherein the compound of Formula (II) is 3-(methysulfamoylethyl)-benzothiazolium salt with tetra fluoroborate as the anion.

11. A color reversal photographic element comprising a support having situated thereon in order from the support a red light-sensitive, cyan dye-forming unit comprising a photosensitive silver halide emulsion layer and an image dye-forming coupler; a green light-sensitive, magenta dye-forming unit comprising two or more emulsion layers spectrally sensitized to the same region of the visible spectrum, but exhibiting different photographic sensitivities, each such emulsion layer containing an image dye-forming coupler; and a blue light-sensitive, yellow dye-forming unit comprising a photosensitive silver halide emulsion layer and an image dye-forming coupler; wherein at least one, but not all, of the emulsion layers of the green light-sensitive magenta dye-forming unit contains the hydrolyzed or unhydrolyzed form of benzazolium compound represented by Formula (I):

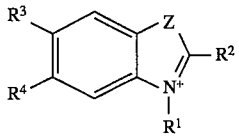

(I)

wherein

Z represents S, Se, or Te;

$R^1$ is an anionic substituted alkyl group of 1 to 4 carbon atoms;

$R^2$ is an aliphatic or aromatic group or hydrogen; and $R^3$ and $R^4$ are individually selected from hydrogen atoms, halogen atoms; nitro groups; cyano groups; carboxy groups; alkyl or aryl groups; alkoxy groups; aryloxy groups, acylamino groups, sulfonamido groups; sulfamoyl groups; sulfamido groups; carbamoyl groups; diacylamino groups; aryloxycarbonyl groups; alkoxycarbonyl groups; alkoxysulfonyl groups; aryloxysulfonyl groups; alkylsulfonyl groups; arylsulfonyl groups; alkylthio groups; arylthio groups; alkoxycarbonylamino groups; aryloxycarbonylamino groups; alkylsulfoxyl groups; arylsulfoxyl groups; alkylureido groups; arylureido groups; alkylcarbonyl groups; arylcarbonyl groups; perfluroalkyl groups; acyl groups; thiocyano groups; heterocyclic groups and acyloxy groups.

12. The photographic element of claim 11 wherein there is a layer comprising colloidal silver or yellow filter dye or both colloidal silver and yellow filter dye, between the blue light-sensitive, yellow dye-forming unit and the green light-sensitive, magenta dye-forming unit.

13. The photographic element of claim 12 wherein there is an interlayer positioned between the blue light-sensitive, yellow dye-forming unit and the layer containing colloidal silver or yellow filter dye or both colloidal silver and yellow filter dye.

14. The photographic element of claim 11 wherein the benzazolium compound is not contained in the least sensitive emulsion layer of the dye-forming unit.

15. The photographic element of claim 14 wherein the green light-sensitive, magenta dye-forming unit comprises halide emulsion layers of low, medium, and high light sensitivity.

16. The photographic element of claim 11 wherein $R^3$ and $R^4$ are individually selected from hydrogen atoms or alkoxy or aryloxy groups of 1 to 20 carbon atoms.

17. The photographic element of claim 11 wherein the anionic substituent on $R^1$ is $SO_3$—, $CO_2$— or $PO_3$—.

18. The photographic element of claim 11 wherein $R^2$ is hydrogen, an alkyl group of 1 to 4 carbon atoms or a phenyl group.

19. The photographic element of claim 11 wherein $R^3$ and $R^4$ are methoxy, $R^2$ is hydrogen and $R^1$ is $CH_2CH_2SO_3$—.

20. The photographic element of claim 11 wherein at least one of the emulsion layers of the dye-forming unit containing the benzazolium compound of Formula (I), also contains a benzazolium salt represented by Formula (II):

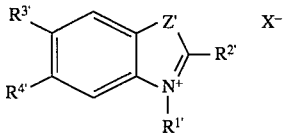

(II)

wherein

Z' represents S, Se, or Te;

$R^{1'}$ is an unsubstituted or nonionic substituted alkyl group of 1 to 4 carbon atoms;

R2' is an alkyl or aryl group or hydrogen;

$R^{3'}$ and $R^{4'}$ are individually selected from hydrogen atoms, halogen atoms; nitro groups; cyano groups; carboxy groups; alkyl or aryl groups; alkoxy groups; aryloxy groups, acylamino groups, sulfonamido groups; sulfamoyl groups; sulfamido groups; carbamoyl groups; diacylamino groups; aryloxycarbonyl groups; alkoxycarbonyl groups; alkoxysulfonyl groups; aryloxysulfonyl groups; alkylsulfonyl groups; arylsulfonyl groups; alkylthio groups; arylthio groups; alkoxycarbonylamino groups; aryloxycarbonylamino groups; alkylsulfoxyl groups; arylsulfoxyl groups; alkylureido groups; arylureido groups; alkylcarbonyl groups; arylcarbonyl groups; perfluroalkyl groups; acyl groups; thiocyano groups; heterocyclic groups and acyloxy groups; and X is an appropriate anion; with the proviso that the compound of Formula (I) and the compound of Formula (II) are not contained in the same emulsion layer.

21. The Photographic element of claim 20 wherein the compound of Formula (II) is 3-(methylsulfamoylethyl)-benzothiazolium salt with tetra fluoroborate as the anion.

22. A color reversal photographic element comprising a support having situated thereon in order from the support a red light-sensitive, cyan dye-forming unit comprising a photosensitive silver halide emulsion layer and an image dye-forming coupler; a green light-sensitive, magenta dye-forming unit comprising two or more emulsion layers spectrally sensitized to the same region of the visible spectrum, but exhibiting different photographic sensitivities, each such emulsion layer containing an image dye-forming coupler; and a blue light-sensitive, yellow dye-forming unit comprising a photosensitive silver halide emulsion layer and an image dye-forming coupler; wherein at least one, but not all, of the emulsion layers of the green light-sensitive magenta dye-forming unit contains the hydrolyzed or unhydrolyzed form of a benzazolium compound represented by Formula (I):

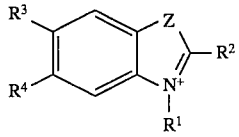

(I)

wherein

Z represents S, Se, or Te;

$R^1$ is an anionic substituted alkyl group of 1 to 4 carbon atoms wherein the anionic substituent is $SO_3$—, $CO_3$— or $PO_3$—;

R2 is hydrogen, an alkyl group of 1 to 4 carbon atoms or a phenyl group; and $R^3$ and $R^4$ are individually selected from hydrogen atoms or alkoxy or aryloxy groups of 1 to 20 carbon atoms;

wherein there is a layer comprising colloidal silver or yellow filter dye or both colloidal silver and yellow filter dye between the blue light-sensitive, yellow dye-forming unit and the green light-sensitive, magenta dye-forming unit; and wherein there is an interlayer positioned between the blue light-sensitive, yellow dye-forming unit and the layer containing colloidal silver or yellow filter dye or both colloidal silver and yellow filter dye.

23. The photographic element of claim 22 wherein the benzazolium compound is not contained in the least sensitive emulsion layer of the dye-forming unit.

24. The photographic element of claim 22 wherein $R^3$ and $R^4$ are methoxy, $R^2$ is hydrogen and $R^1$ is $CH_2CH_2SO_3^-$.

25. The photographic element of claim 22 wherein at least one of the emulsion layers of the dye-forming unit containing the benzazolium compound of Formula (I), also contains 3-(methylsulfamoylethyl)-benzothiazolium salt with tetrafluoroborate as the anion, provided that the compound of Formula (I) and the 3-(methylsulfamoylethyl)-benzothiazolium salt are not contained in the same emulsion layer.

* * * * *